US005082054A

United States Patent [19]

Kiamanesh

[11] Patent Number: 5,082,054

[45] Date of Patent: Jan. 21, 1992

[54] IN-SITU TUNED MICROWAVE OIL EXTRACTION PROCESS

[76] Inventor: Anoosh I. Kiamanesh, 5603 Yalta Pl., Vancouver, Canada

[21] Appl. No.: 571,770

[22] Filed: Aug. 22, 1990

[30] Foreign Application Priority Data

Feb. 12, 1990 [CA] Canada ..... 2009782

[51] Int. Cl.[5] ..... E21B 43/24; E21B 49/00

[52] U.S. Cl. ..... 166/248; 166/50; 166/60; 166/65.1; 166/250; 294/2

[58] Field of Search ..... 166/50, 60, 65.1, 248, 166/250, 302; 299/2, 14

[56] References Cited

U.S. PATENT DOCUMENTS

| | | | |
|---|---|---|---|
| 2,757,783 | 8/1956 | Zacur . | |
| 3,133,592 | 5/1964 | Tomberlin . | |
| 4,067,390 | 1/1978 | Camacho et al. | 166/302 |
| 4,140,180 | 2/1979 | Bridges et al. | 166/248 |
| 4,193,448 | 3/1980 | Jeambey | 166/60 |
| 4,265,307 | 5/1981 | Elkins | 166/50 X |
| 4,320,801 | 3/1982 | Rowland et al. | 166/248 |
| 4,396,062 | 8/1983 | Iskander | 166/248 |
| 4,457,365 | 7/1984 | Kasevich et al. | 166/248 |
| 4,485,868 | 12/1984 | Sresty et al. | 166/248 |
| 4,485,869 | 12/1984 | Sresty et al. | 166/248 |
| 4,508,168 | 4/1985 | Heeren | 166/248 |
| 4,524,826 | 6/1985 | Savage | 166/248 |
| 4,545,435 | 10/1985 | Bridges et al. | 166/248 |
| 4,620,593 | 11/1986 | Haagensen | 166/248 |
| 4,638,863 | 1/1987 | Wilson | 166/248 |
| 4,678,034 | 7/1987 | Eastlund et al. | 166/248 |
| 4,743,725 | 5/1988 | Risman | 166/248 X |
| 4,817,711 | 4/1989 | Jeambey | 166/248 |

*Primary Examiner*—George A. Suchfield
*Attorney, Agent, or Firm*—Trask, Britt & Rossa

[57] ABSTRACT

A method of creating a protocol for oil extraction or for enhancing oil extraction from oil reservoirs. A process of devising and applying a customized electromagnetic irradiation protocol to individual reservoirs. Reservoir samples are tested to determine their content, molecular resonance frequencies and the effects of electromagnetic field on their compounds. Electromagnetic field frequencies, intensities, wave forms and durations necessary to heat and/or crack individual molecules and produce plasma torches is determined. Equipment are selected and installed according to the results of the laboratory tests and the geophysics of the mine. Dielectric constant of the formation is reduced by draining the water and drying it with electromagnetic energy. A combination of the effects of microwave flooding, plasma torch activation, molecular cracking and selective heating are used to heat the oil within the reservoir, by controlling frequency, intensity, duration, direction and wave form of the electromagnetic field. Conditions of there servoir are continuously monitored during production to act as feedback for modification of the irradiation protocol.

25 Claims, 8 Drawing Sheets

IN-SITU TUNED MICROWAVE OIL EXTRACTION PROCESS

FIELD OF THE INVENTION

This invention relates to a method of oil extraction or enhancing oil extraction from oil reservoirs with particular application for extraction from tar sands and oil shale reservoirs.

BACKGROUND OF THE INVENTION

In the prior art, various aspects of application of electromagnetic energy to oil extraction have been explored. U.S. Pat. Nos. 2,757,783; 3,133,592; 4,140,180; 4,193,448; 4,620,593; 4,638,863; 4,678,034; and 4,743,725 have mainly dealt with development of specific apparatus for reducing viscosity by using standard microwave generators.

U.S. Pat. Nos. 4,067,390; 4,485,868; 4,485,869; 4,638,863; and 4,817,711 propose methods of applying microwaves to heat the reservoir and extract oil. All of these methods are concerned with fixed frequencies and one specific technique of extraction.

In order to provide an industrially acceptable solution, there is still a need for approaching this problem with a global outlook. Since each reservoir has its own specific and individual characteristics, it requires a unique and customized protocol for oil extraction.

Use of microwave irradiation technology in oil reservoir extraction had limitations such as depth of penetration and efficiency. It had been believed that because of the high frequencies of microwaves and the high dielectric constant of the reservoirs, much of the microwave energy is absorbed within a short distance. Thus microwaves had been considered to offer limited solution for these purposes.

An important area that all previous approaches have failed to recognize is the consequences of manipulation of electromagnetic field frequency at a molecular level.

Current techniques have not properly addressed the efficiency and consequently the economic feasibility of a microwave process for a specific oil reservoir.

SUMMARY OF THE INVENTION

This invention is directed to a process of developing and applying unique irradiation protocols specific and customized to the requirements of individual reservoirs.

Briefly the invention is a process of devising and applying an electromagnetic irradiation protocol customized to each reservoir. This protocol controls frequency, intensity, wave form, duration and direction of irradiation of electromagnetic energy in such a way that it generates and utilizes the desired combination of effects defined as microwave flooding, selective heating, molecular cracking and plasma torch activation, under controlled conditions in time and space within the reservoir. Utilizing these effects makes this process the first economically feasible application of electromagnetic energy to extract oil from reservoirs.

The invention is directed to an in-situ method for partially refining and extracting petroleum from a petroleum bearing reservoir by irradiation of the reservoir with electromagnetic energy of high frequency of mainly microwave region, comprising: (a) taking at least one core sample of the reservoir; (b) testing the core sample to determine the respective amounts of constituent hydrocarbons in the petroleum, the molecular resonance frequencies of the hydrocarbons, the change in properties and responses to various frequencies, intensities, durations, and wave forms of electromagnetic field energy applied to the hydrocarbons; (c) developing a strategy for the application of electromagnetic energy to the reservoir based on the results of core sample tests and geophysical data and water content of the reservoir; (d) excavating at least one canal or well in the reservoir for draining water from the reservoir and collecting hydrocarbons from the reservoir; (e) generating electromagnetic waves of mainly microwave frequency range and deploying the electromagnetic waves to the reservoir to irradiate the hydrocarbons within the reservoir and thereby produce one or more of microwave flooding, plasma torch, molecular cracking and selective heating of pre-determined hydrocarbons in the reservoir, to increase temperature and reduce viscosity of the hydrocarbons in the reservoir; and (f) removing the treated hydrocarbons from the underground canal or well.

BRIEF DESCRIPTION OF THE DRAWINGS

In drawings which illustrate specific embodiments of the invention, but which should not be construed as restricting or limiting the scope of the invention in any way.

DESCRIPTION OF THE PREFERRED EMBODIMENT

The subject invention involves a process of oil extraction using electromagnetic energy which exploits the effects of variation of field intensity frequency corresponding to the natural frequency of the constituent hydrocarbons within the reservoir in increasing efficiency of the process.

The protocol development involves study of the reservoir through core samples as well as topographic and geophysical data. The core samples are tested to determine their content, as well as their molecular natural frequencies and effects of E.M. waves on them with respect to physical and chemical changes that can be manipulated.

Based on the results of these studies, an extensive network of wells and canals are developed to be used for water drainage, housing of equipment, and collection of heated oil.

The dielectric constant of the reservoir is reduced by initially draining the water, and eventually evaporating the remaining moisture by using microwaves.

A customized irradiation protocol is developed which requires independent control of frequency, intensity, wave form, duration and direction of electromagnetic irradiation. Throughout the irradiation phase, temperature distribution, pressure gradients and dielectric constant of the reservoir are monitored to act as feedback for modification of the protocol. Through this control a combination of microwave flooding, molecular cracking, plasma torch initiation, and partial liquefaction through selective heating is obtained which can efficiently heat the reservoir to extract oil.

Theoretically, the application of high frequency electromagnetic energy affects a petroleum bearing reservoir in the following manner. Through the rapidly fluctuating electromagnetic field, polar molecules are rotated by the external torque on their dipole moment. Molecules with their molecular resonance frequencies closer to a harmonic of that of the field energy, absorb more energy. This provides a means of manipulating the reservoir by exciting different molecules at different frequencies, to achieve more efficient extraction.

Figure 1:
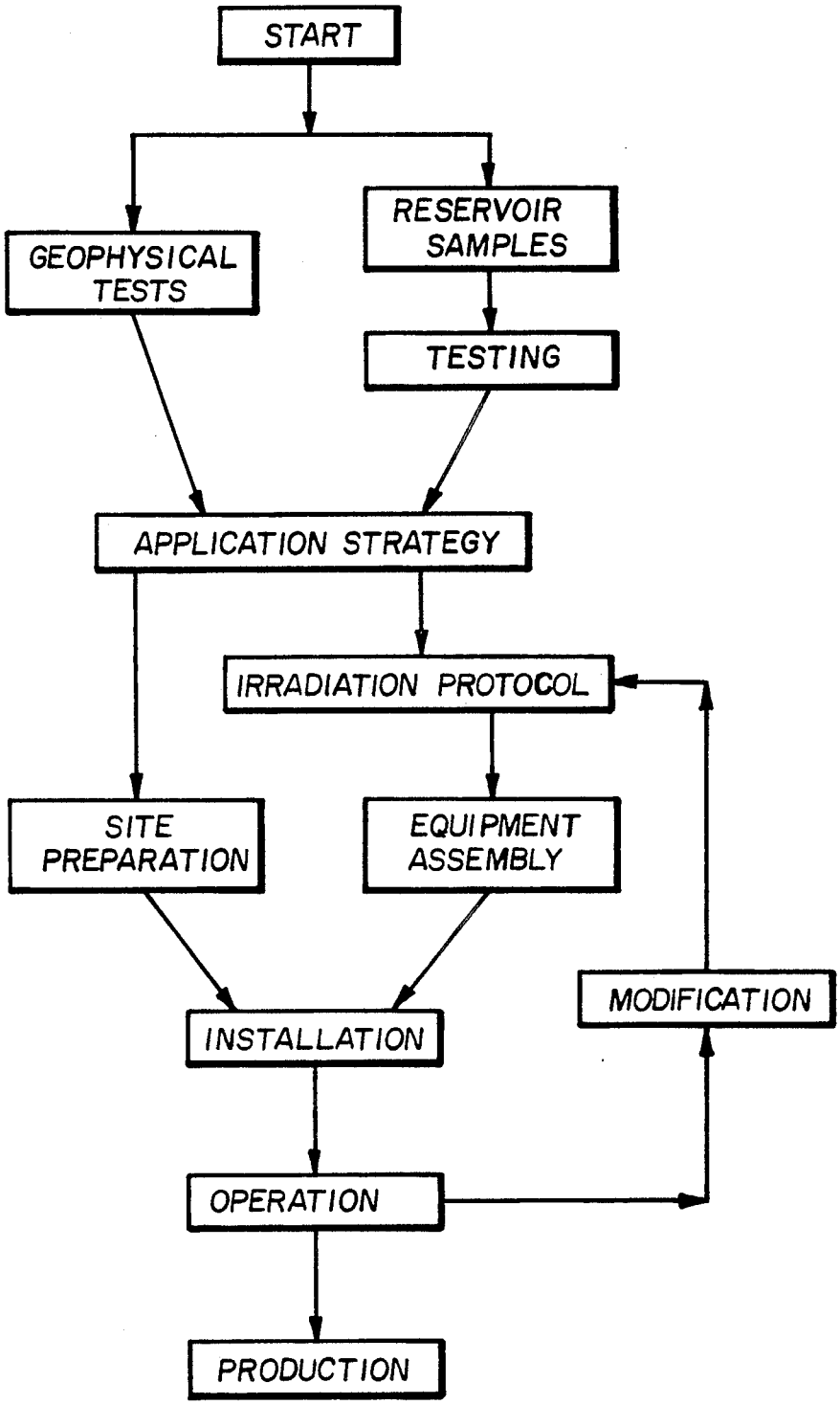
FIG. 1 is a schematic flow chart diagram outlining the major steps of the process of the invention in devising and applying an irradiation protocol to the reservoir.

Referring to the drawings, FIG. 1 is a flow chart of a process of devising and applying an irradiation protocol that outlines as an example the major steps required in customizing and applying the method of the invention to oil (petroleum) reservoirs. As shown in FIG. 1, initially reservoir samples are taken and tested. Simultaneously, the geophysical nature of the reservoir as well as its water content are determined through field tests and surveys. Based on the results of these tests, an application strategy is designed. This application strategy includes site design consisting of access road, installations, water drainage and oil extraction network, as well as an irradiation protocol. The type of drainage network and irradiation protocol selected determine the type and quantity of equipment to be assembled. Then equipment is installed and irradiation operation and extraction begins. Throughout the operation, attention is given to the feedo back from the reservoir and the extracted material. Based on the feedback, both irradiation protocol and the equipment are constantly modified.

The following describes the steps of FIG. 1 in greater detail.

The first step in devising the customized irradiation protocol is to perform a number of tests on the reservoir samples. These tests include experiments to determine the effects of various frequencies, intensities, wave forms and durations of application of electromagnetic field on reservoir samples. Attention is given to the resultant physical and chemical reactions, including the onset of cracking of larger molecule hydrocarbon chains into smaller ones. Furthermore, tests are done to determine the molecular resonance frequencies of constituent hydrocarbons of the reservoir samples. One such relevant test is microwave spectroscopy.

Field tests include determination of the geophysical nature of the mine, as well as the water content of the reservoir.

Based on these results, an application strategy is designed. The first part of this strategy involves selection of equipment and design of underground canals and wells in the reservoir. The underground canals and wells form an extensive network which is used for three purposes. Firstly, to act as a drainage system for much of the water content of the reservoir. Secondly, during production stages, the network acts as housing for equipment such as microwave generators, wave guides, reflectors, data collection and feedback transducers and instruments. Thirdly, the network acts as a collection system for extraction of oil from the reservoir.

Figure 2:
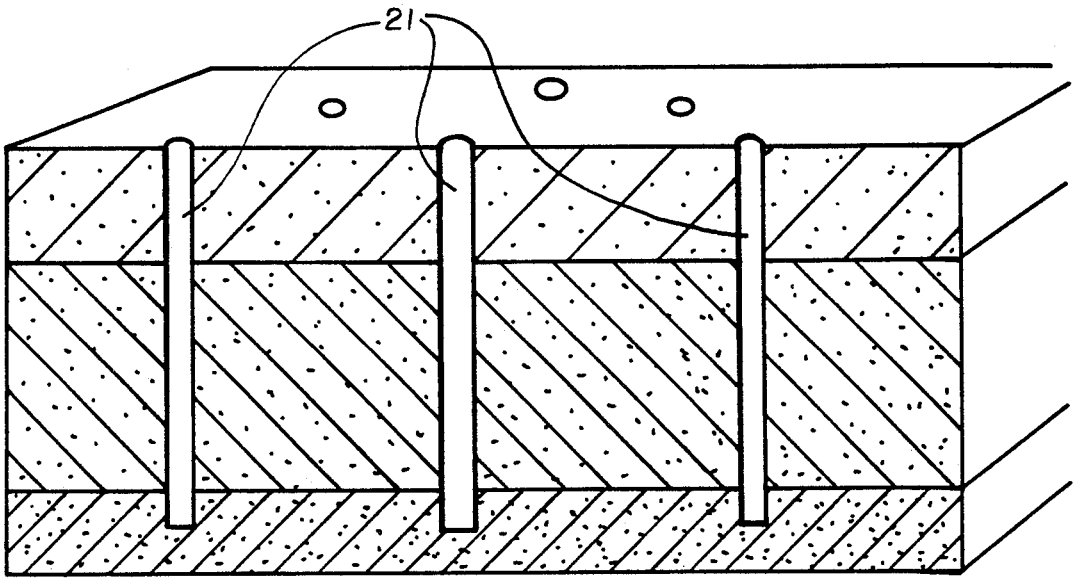
FIG. 2 is a representation of a drainage network with vertical wells in a petroleum reservoir.
Figure 3:
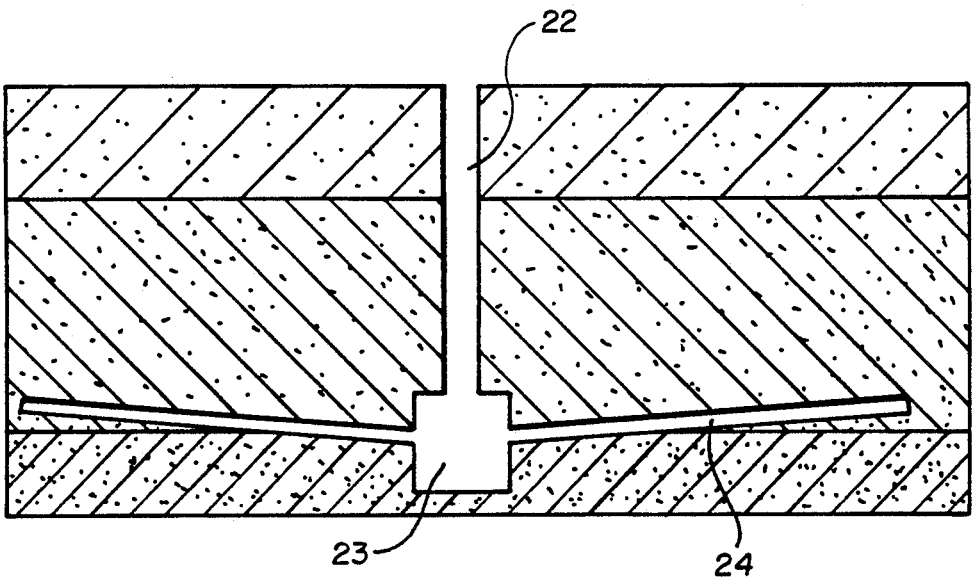
FIG. 3 is a representation of a drainage network with near horizontal underground canals in a petroleum reservoir.
Figure 4:
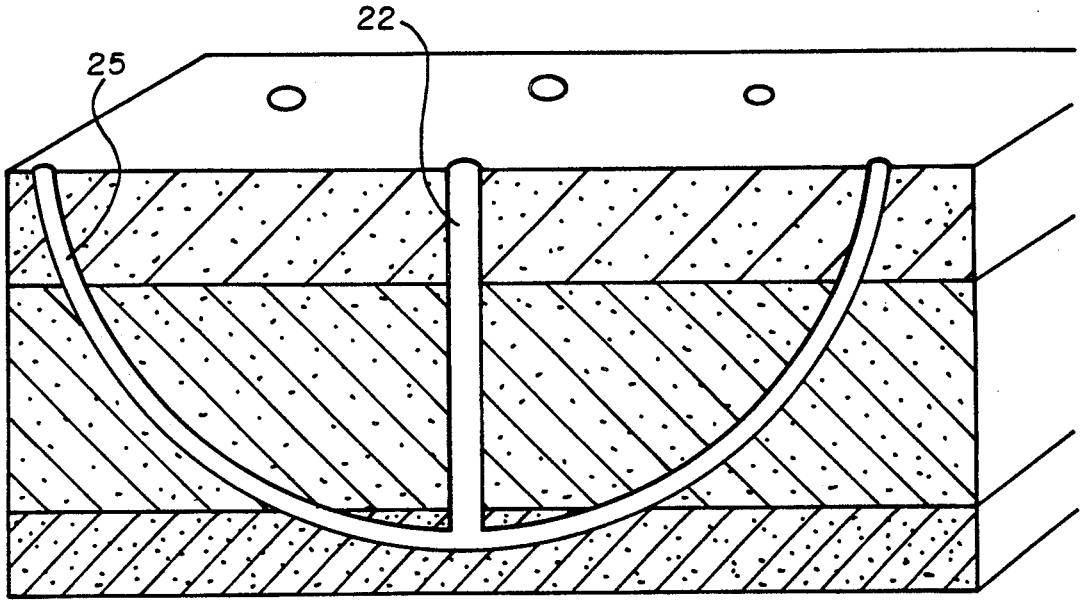
FIG. 4 is a representation of a drainage network with directionally controlled drilled wells and canals in a petroleum reservoir.

Some typical reservoir networks are shown in FIGS. 2, 3, 4. These figures show some of the options available in developing such a network. Different reservoirs with different depths and geology require different approaches to such development. FIG. 2 shows a series of vertical wells 21. FIG. 3 shows a central well 22 with an underground gallery 23 from which a series of near horizontal canals 24 emerge. These canals 24 span the cross sectional area of a part of the reservoir and act as both drainage canals and as collection canals. FIG. 4 represents an inverted umbrella or mushroom network which is useful for locations where underground galleries are too costly or impractical to build. These canals 25 converge to a central vertical collection well 22 extending to the surface. The design of the network depends on both topographical and geophysical data as well as the type of equipment to be installed.

The second part of the application strategy is to devise a customized irradiation protocol based on the results of the laboratory tests, and geophysical data and the water content of the reservoir. This protocol outlines a set of guidelines about choosing appropriate frequencies of electromagnetic field to be applied, controlling the time and duration of their application, field intensities, wave forms and direction of irradiation. In this way, this o invention enables control of the heating process with respect to time, in appropriate and predetermined locations within the reservoir. At the same time, control over frequencies and intensities determines the compounds within the reservoir that absorb most of the irradiated energy at that time.

Figure 5:
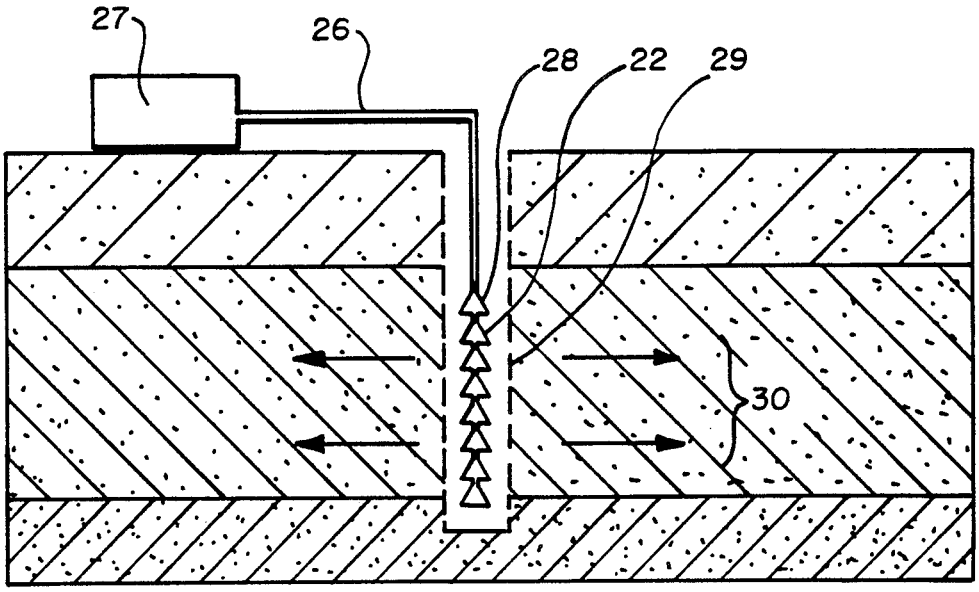
FIG. 5 is a representation of microwave irradiation of a reservoir by using a surface generator with wave guides and reflectors.
Figure 6:
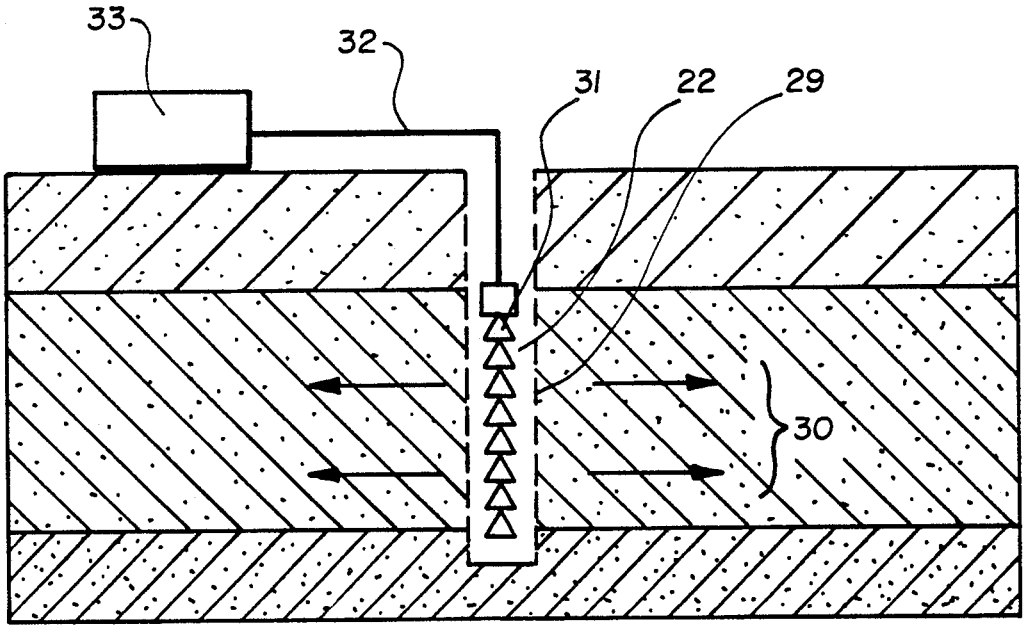
FIG. 6 is a representation of direct microwave irradiation of a reservoir by using a down hole generator.
Figure 7:
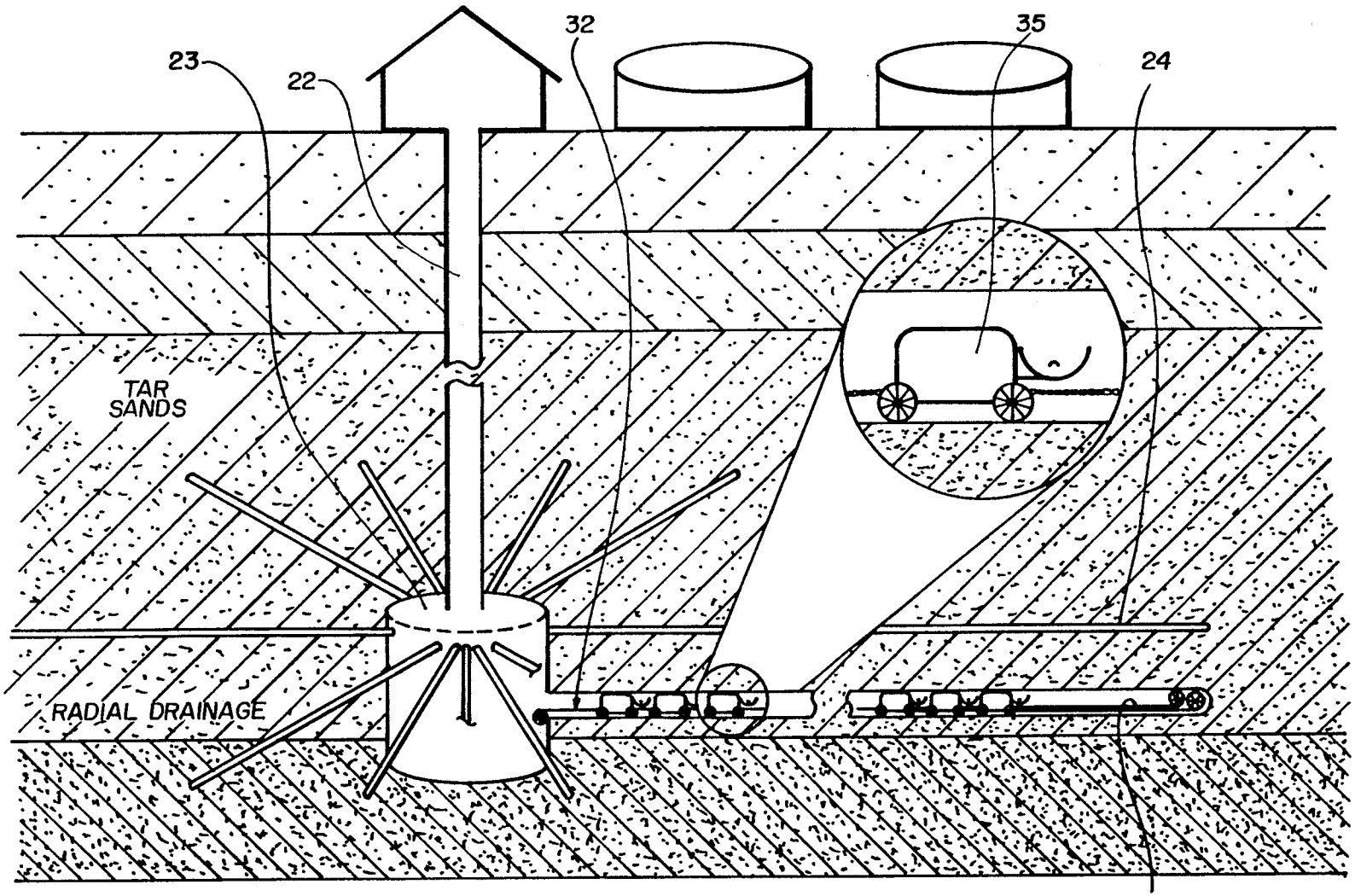
FIG. 7 is a representation of direct microwave irradiation of a reservoir by using distributed underground sources.

The design of the irradiation protocol also includes selecting and assembling appropriate equipment. As shown in FIG. 5, the microwave generators 27 may be required to remain above ground, and through the use of wave guides 26 and reflectors 28 transmit microwave energy down the well 22, to irradiate the reservoir 30. Alternatively as in FIG. 6, there may be down-hole generators 31. A further alternative is a series of lower power microwave generators 35 which act as a number of distributed sources as shown in FIG. 7. In this case, the underground canals may be of two groups. One for drainage purposes 24, and the other for equipment housing 34. In the latter two cases, illustrated in FIGS. 6 and 7, low frequency electrical energy is transferred from an electrical source 33 to the underground generators 31, 35 through the use of electrical cables 32. It is there that the electrical energy is converted to high frequency electromagnetic waves. In all cases the well 22 is lined with a microwave transparent casing 29.

The next stage is to install the equipment on surface and within the underground network of canals and wells. Furthermore, there may be a need to use reflectors or diffusers. The nature of required irradiation determines the types of reflectors or diffusers that should be used. For example, if small area irradiation is required, parabolic reflectors are used, whereas if large volume irradiation is required, diffusers and dispersing reflectors are used. Furthermore, by means of reflectors, direction of irradiation can be controlled, thus adding targeting abilities to the process.

In the case of distributed source, since numerous generators of identical specifications are manufactured, each generator will cost much less. In addition, the whole system becomes more reliable since failure of one generator eliminates only a small part of the generating power at that frequency, whereas with the higher power generators, one failure eliminates one frequency.

Figure 8:
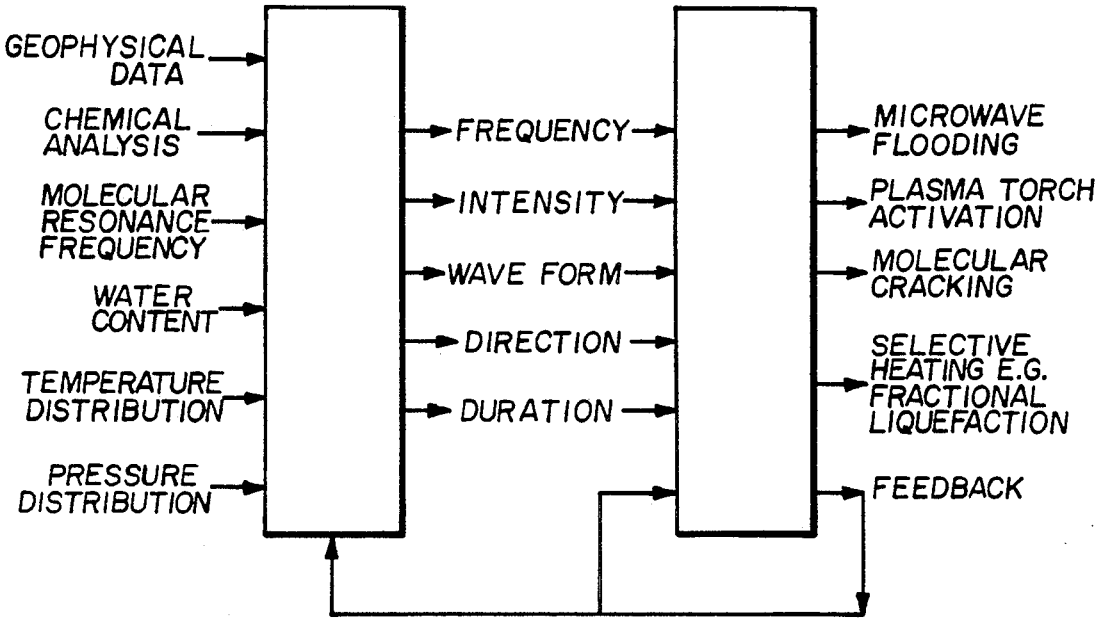
FIG. 8 is a schematic representation of the test and feedback being transformed to control parameters which themselves produce heating and partial refining effects.

After a stage of substantial water drainage is conducted, production begins. Microwave irradiation proceeds according to the devised protocol. Generally, as shown in FIG. 8, the five parameters of frequency, intensity, wave form, duration and direction of irradiation are controlled in such a manner that within various predetermined parts of the reservoir, desired physical and chemical reactions take place.

The application phase of the irradiation protocol includes the following:

Lowering the dielectric constant of the reservoir by draining the water through the network as a pre-production step;

Drying the formation by microwave flooding;

Activating plasma torches in various parts of the reservoir to generate heat;

Exposing some heavier hydrocarbons to specific frequencies which cause them to undergo molecular cracking into lighter hydrocarbons; and Manipulating parts of the reservoir with various frequencies of electromagnetic field at predetermined intensities to produce the desired selective heating effect.

Meanwhile, through the use of transducers within the reservoir, and by testing the extracted material, a feedback loop is completed. Data such as temperature distribution, pressure gradients and dielectric constant of the reservoir are monitored in order to modify and update the irradiation protocol, and to modity or include any necessary equipment.

The electromagnetic wave generators used in the invention are of two types. Initially Klystrons which can be tuned to the frequencies near or equal to that of the molecular resonance frequencies of the hydrocarbon fluids are used. These Klystrons operate until they are fine tuned to more exact operational frequencies. After the fine tuning is completed, Magnetrons that produce those fine tuned frequencies are produced and replace the Klystrons. Magnetrons are more efficient and economical but do not give the variable frequency range that is produced by Klystrons. It must be noted that in particular cases, it may be more economical and convenient to use Klystrons for all parts of the operation. This is particularly the case if the molecular resonance frequencies of a number of hydrocarbons present in that reservoir falls within a small frequency band.

Each major step of the production phase is described below in more detail.

A high dielectric constant of the reservoir was a major cause of short depth of penetration. In this invention, by draining much of the free water within the reservoir through the drainage network of canals and wells, and evaporating the remaining moisture by microwave flooding, the dielectric constant is lowered and depth of penetration increased.

Microwave flooding is commenced by activating electromagnetic waves corresponding to the molecular resonance frequency of water with 2.45 GHz or 8915 mHz magnetrons. As a result of heating by this process, the water layer nearest the source of irradiation is evaporated. After this stage, microwave flooding corresponding to the natural frequencies of major hydrocarbons begins. This process heats the oil nearest the source within the formation. The heating process reduces the viscosity of the oil. In certain cases, gases and lighter hydrocarbons may be heated further to generate a positive vapour pressure gradient that pushes the liquefied oil from the reservoir into the network.

Figure 9:
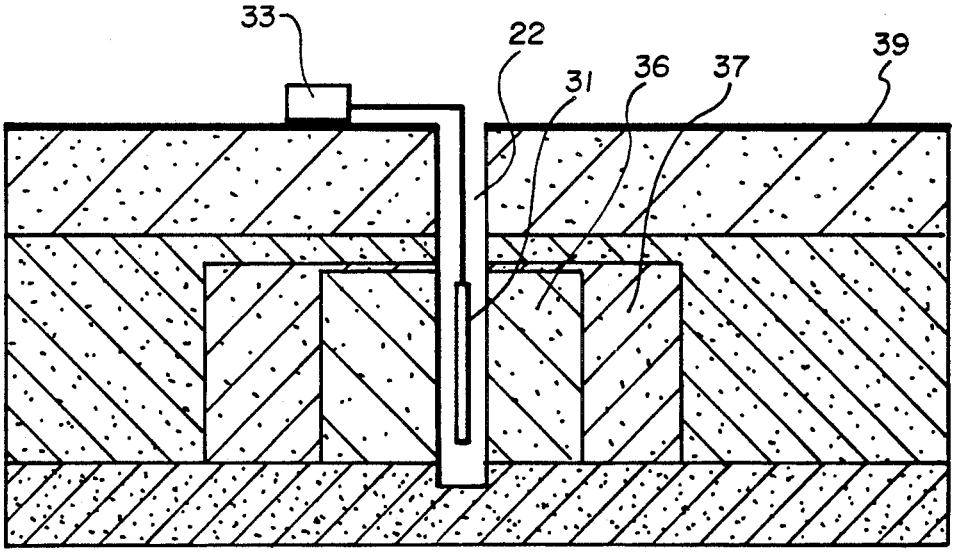
FIG. 9 is a representation of the nature of microwave flooding underground in a petroleum reservoir.

After drainage of this fluid, the zone which was drained remains permeable and transparent to microwaves. The microwaves then start acting on the adjacent region 37 of the reservoir, as shown in FIG. 9. This figure shows the depleted zone 36 nearest the microwave source 31, and adjacent the active region 37 where the formation undergoes heating, and further unaffected zones which have to wait until the microwave flooding reaches them.

Figure 10:
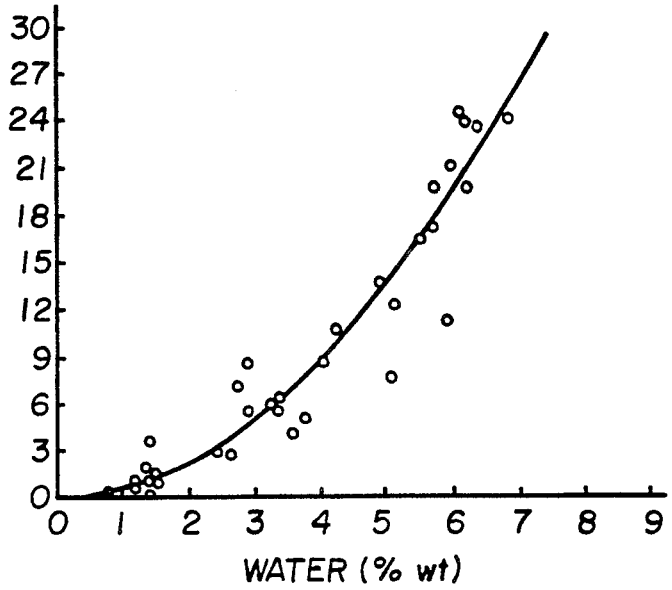
FIG. 10 is a graph of relative dielectric constant Vs. water content of a petroleum reservoir.

In reality, as water evaporates, the dielectric constant of the reservoir is greatly reduced. This reduction as can be seen from the graph in FIG. 10, increases the depth of microwave penetration, thus enabling the 2.45 GHz microwaves to gradually reach the regions further from the source. In this way, there is always some water vapour pressure generated behind the region in which petroleum is being heated. Thus, there is constantly a positive pressure gradient to push the heated oil towards the collection network of canals and wells. A progressive drainage of the reservoir takes place.

Under certain conditions, when the hydrocarbons within the formation are exposed to high intensity microwaves, they enter an exothermic plasma phase. This well known phenomenon is referred to as plasma torch activation. During this phase, molecules undergo exothermic chemical gaseous decomposition which creates a source of heat from within the reservoir. The parameters of frequency and field intensity required to trigger plasma torch in any particular reservoir are determined from laboratory tests. Therefore, in the irradiation protocol, strategic locations are determined for the activation of plasma torches to aid in heating the formation. This is generally done by using one high intensity microwave source which uses reflectors for focusing the radiation into a high energy controlled volume. Alternatively, this is achieved by using a number of high intensity microwave sources that irradiate predetermined locations from different directions. The cross section of their irradiation paths exposes the formation to the required energy level, which activates plasma torches.

When heavier molecule hydrocarbon chains are exposed to certain harmonics of their natural frequency, they become so agitated that the molecular chain breaks into smaller chains. This chemical decomposition is referred to as molecular cracking. During the operation, at predetermined times, the heavier molecules within the reservoir may be exposed to such frequencies of electromagnetic field energy at intensities that cause them to undergo molecular cracking. In this way, more viscous, heavier hydrocarbon molecules are broken into lighter, more fluid hydrocarbons. Thus the quality of the extracted oil becomes lighter. This process is particularly useful for tar sand and oil shale deposits where the petroleum is of a heavy grade.

While the depth of penetration is increased, electromagnetic wave sources of various frequencies are activated according to the results of the laboratory tests and the irradiation protocol. Each frequency corresponds to the natural frequency of the molecules of one hydrocarbon. Thus irradiation of the reservoir at that frequency causes the hydrocarbon molecules with that particular natural frequency to resonate. In this way, desireable hydrocarbons are exposed to and thus absorb more energy. Therefore, partial liquefaction and thus partial in-situ refining is achieved before the oil leaves the reservoir. Also, when necessary, the same technique can be used to evaporate lighter oils or agitate gases to generate a larger positive pressure gradient in order to facilitate the flow of liquefied hydrocarbons into the collection network.

For example, microwave frequencies that excite heavier hydrocarbons may be used for a long duration initially. When their viscosity is lowered sufficiently, a short duration of another microwave frequency that excites gaseous compounds is used at high intensities to create a pressure gradient which forces the heavier hydrocarbons into the collection wells.

Furthermore, water, which acts as a hindrance and a problem in other techniques, can be used to advantage in this case. If a little moisture is still present in the reservoir, during the pressure building phase of the protocol, water molecules may be excited to such an extent that they produce vapour (steam) which adds to the desired pressure gradient.

A microwave reflective foil 39 as shown in FIG. 9, may be used to cover the surface of some reservoirs. This foil 39 has two major benefits: It prevents addition of precipitated water to the reservoir and thereby reduces the energy needed to dry the newly precipitated water. It also reflects the microwaves that reach the surface back down to the reservoir. This action increases efficiency as well as prevents possible environmental hazards.

Figure 11:
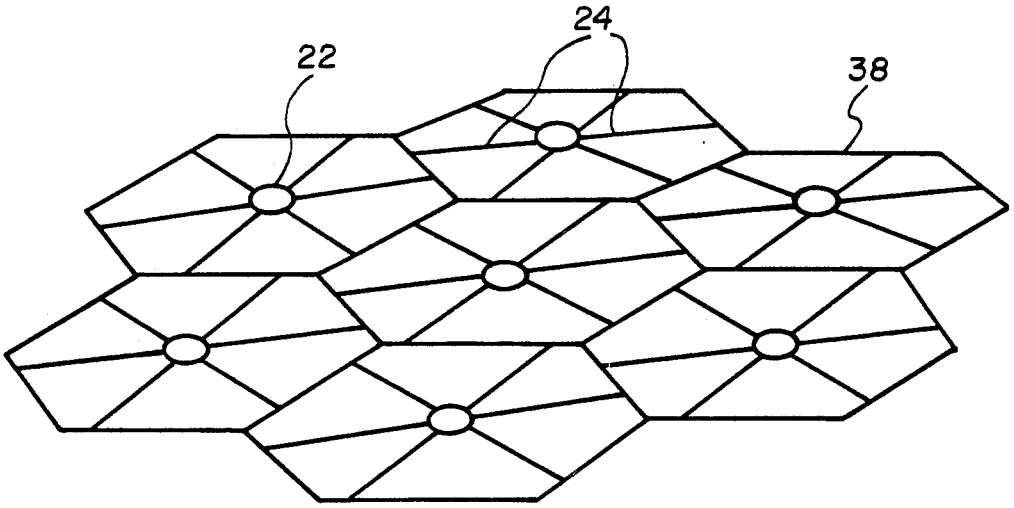
FIG. 11 is a representation of an efficient layout of adjacent underground canal networks to contribute to each other's effect.

As shown in FIG. 11, within a reservoir, a complex interconnecting set of underground canal and well networks may be designed. These networks are designed in such a way that the radiation from one area 38 may penetrate the region covered by another and vice versa. In this way, the energy that would otherwise have been wasted by heating the formation outside the collection zone, falls within the collection zone of an adjacent network 38, thus increasing the efficiency.

Figure 12:
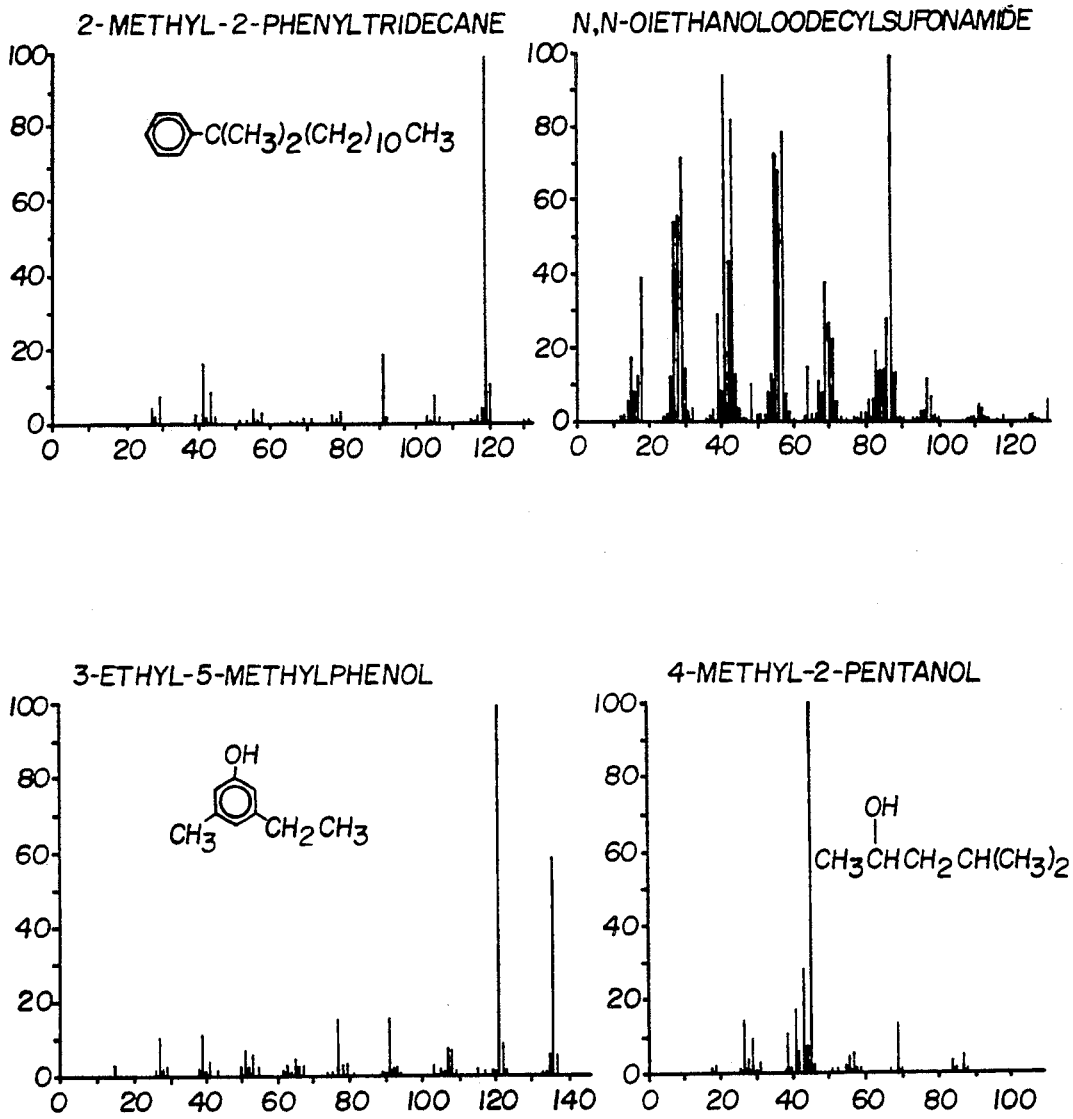
FIG. 12 is a graph of intensity vs. frequency wave length for four different hydrocarbons showing the molecular resonance frequencies as peaks.

Finally, FIG. 12 shows the spectrometry results of four specific hydrocarbons. This spectroscopy pinpoints the molecular resonance frequencies of these four hydrocarbons. Most of the time, by knowing the compounds present, these frequencies can be determined by looking up tables of results. However, in some cases it may be required to perform spectrographic tests on core samples of the reservoir or particular compounds of the core samples in order to have results.

EXAMPLE

In an experiment performed in Middleborough, Mass., in November, 1988, 2.2 lb. samples of oil shale were irradiated by using a 1500 W magnetron, and the following facts were observed.

Initially, the water in the shale absorbed heat, caused expansion, and caused cracking of the shale structure, until the water was evaporated. In a next phase, sulphurous gases were emitted, followed by the emission of petroleum gases, which were larger in volume than the petroleum evaporation due to thermal heating of the same volume in a control sample. The colour of the shale changed from a light grey to a shiny tar black, as the oil was exuded from the shale.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. An in-situ method for partially refining and extracting petroleum from a petroleum bearing reservoir by irradiation of the reservoir with electromagnetic energy of high frequency of mainly microwave region, comprising:

(a) ascertaining geophysical data and water content of the petroleum bearing reservoir;

(b) taking at least one core sample of the reservoir;

(c) testing the core sample to determine the respective amounts of constituent hydrocarbons in the petroleum, the molecular resonance frequencies of the respective constituent hydrocarbons, and the change in properties and responses of the respective constituent hydrocarbons to various frequencies, intensities, durations and wave forms of electromagnetic field energy applied to the hydrocarbons;

(d) developing a strategy for the application of electromagnetic energy to a selected constituent hydrocarbon or group of constituent hydrocarbons in the reservoir based on the results of the core sample tests and the geophysical data and water content of the reservoir;

(e) excavating at least one canal or well in the reservoir for draining water from the reservoir and collecting hydrocarbons from the reservoir;

(f) generating electromagnetic waves of mainly microwave frequency range and deploying the electromagnetic waves to the reservoir to irradiate a selected constituent hydrocarbon or a group of constituent hydrocarbons within the reservoir and thereby produce one or more of microwave flooding, plasma torch, molecular cracking and selective heating of the pre-determined hydrocarbon or group of constituent hydrocarbons in the reservoir, to increase temperature and reduce viscosity of the selected constituent hydrocarbon or groups of constituent hydrocarbons in the reservoir so that they flow into the underground canal or well; and (g) removing the treated selected constituent hydrocarbon or group of constituent hydrocarbons from the canal or well.

2. The method of claim 1 wherein the developed strategy includes reducing the dielectric constant of the hydrocarbon in the reservoir to increase the depth of penetration of microwaves by draining water and by irradiating the reservoir with microwaves from a microwave source within the reservoir to dry water nearest the microwave source, and sequentially continue this method to the next closest region to the microwave source, until such time that as the dielectric constant of a significant portion of the reservoir is reduced and greater depth of penetration of microwaves in the reservoir is achieved.

3. The method of claim wherein the developed strategy includes controlling the intensity, direction and duration of the generated electromagnetic wave irradiation with frequencies corresponding to the molecular resonance frequencies of selected constituent hydrocarbons in the reservoir, to thereby heat the hydrocarbons within the reservoir so that the hydrocarbons nearest the source of irradiation are heated and are evaporated or experience reduced viscosity so that the hydrocarbons flow into the collection canal or well under vapour pressure or gravity.

4. The method of claim 1 wherein electromagnetic waves of a predetermined substantially pure frequency corresponding to the molecular resonance frequency of a constituent hydrocarbon within the reservoir as determined by the core testing, are generated, and with a controlled intensity corresponding to such frequency.

5. The method of claim 4 wherein the predetermined substantially pure frequency and intensity correspond to the molecular resonance frequency and intensity at which the selected constituent hydrocarbon molecular cracking.

6. The method of claim 4 wherein the predetermined substantially pure frequency and intensity correspond to the molecular resonance frequency and intensity at which the selected constituent hydrocarbon within the reservoir enters an exothermic plasma phase.

7. The method of claim 4 Wherein microwaves of at least one pre-determined frequency are generated to heat a selected hydrocarbon, thereby increasing its temperature and lowering its viscosity.

8. The method of claim 7 wherein irradiation microwaves are directionally controlled by a parabolic or directional antenna to provide selective heating of selected regions of the reservoir.

9. The method of claim 4 wherein the intensity, duration and direction of irradiation of at least one high intensity microwave of a frequency corresponding to the molecular resonance frequency of at least one selected constituent hydrocarbon within the reservoir is controlled to initiate a plasma torch effect in pre-determined locations within the reservoir.

10. The method of claim 9 wherein at least two high intensity microwaves are generated from separate microwave sources and focused on a selected region of the reservoir, the union of the irradiation from the two sources producing a high energy zone in the reservoir where plasma torches are activated.

11. The method of claim 1 wherein the duration, intensity and frequency of the microwaves is controlled to initially lower the viscosity of heavier selected constituent hydrocarbons in the reservoir, and subsequently heat lighter selected constituent hydrocarbon in the reservoir to produce high pressure gaseous compounds which generate a pressure gradient that moves the heavier selected constituent hydrocarbons into the well or canal.

12. The method of claim 1 wherein the testing includes spectrometry of the constituent hydrocarbons in the reservoir to determine the molecular resonance frequencies of the hydrocarbons.

13. The method of claim 1 wherein the testing involves exposing the core sample to an electromagnetic field of mainly microwave frequency range to determine chemical reactions and byproducts of the constituent hydrocarbons.

14. The method of claim 1 wherein the testing determines the frequency, intensity and wave form variation that induces molecular cracking of the hydrocarbons within the core sample.

15. The method of claim 1 wherein at least one electromagnetic wave generator above the reservoir generates the electromagnetic waves, the generator converting low frequency electrical energy to high frequency electromagnetic energy, and the electromagnetic energy is transferred to the reservoir by wave guides and reflectors to irradiate the selected constituent hydrocarbons in the reservoir.

16. The method of claim 1 wherein the electromagnetic waves are generated by a generator which transfers low frequency electrical energy to a down hole device which converts the energy to high frequency electromagnetic energy to irradiate selected constituent hydrocarbons in the reservoir.

17. The method of claim 1 wherein the electromagnetic waves are generated by a plurality of low power microwave generators which are placed in one or more groups above the reservoir or in a well to irradiate selected constituent hydrocarbons in the reservoir.

18. The method of claim 1 wherein the area above the reservoir is covered by microwave reflective foil to reflect the electromagnetic radiation to the reservoir.

19. The method of claim 1 wherein two adjacent networks of electromagnetic irradiation are generated by two separate groups of microwave generators and the networks are utilized to have a cumulative effect.

20. The method of claim 1 wherein the reservoir is a tar sands deposit.

21. The method of claim 1 wherein the reservoir is an oil shale reservoir.

22. The method of claim 1 wherein the reservoir is a partially depleted petroleum reservoir.

23. An in-situ method for partially refining and extracting petroleum from a petroleum bearing reservoir by irradiation of the reservoir with electromagnetic energy of high frequency of mainly microwave region, comprising:

(a) ascertaining geophysical data and water content of the petroleum bearing reservoir;

(b) taking at least one core sample of the reservoir;

(c) testing the core sample to determine the respective amounts of constituent hydrocarbons in the petroleum, the molecular resonance frequencies of the respective constituent hydrocarbons, and the change in properties and responses of the respective constituent hydrocarbons to various frequencies, intensities, durations and wave forms of electromagnetic field energy applied to the hydrocarbons;

(d) developing a strategy for the application of electromagnetic energy to a selected constituent hydrocarbon or group of constituent hydrocarbons in the reservoir based on the results of the core sample tests and the geophysical data and water content of the reservoir;

(e) excavating at least one canal or well in the reservoir;

(f) draining water from the reservoir to reduce the dielectric constant of the hydrocarbon in the reservoir thereby increasing the depth of penetration of microwaves which are subsequently directed to the reservoir;

(g) generating electromagnetic waves of mainly microwave frequency range and deploying the electromagnetic waves to he reservoir to irradiate a selected constituent hydrocarbon or a group of constituent hydrocarbons within the reservoir and thereby produce one or more of microwave flooding, plasma torch, molecular cracking and selective heating of the pre-determined hydrocarbon or group of constituent in the reservoir, to increase temperature and reduce viscosity of the selected constituent hydrocarbon or group of constituent hydrocarbons in the reservoir so that they flow into the underground canal or well; and (h) removing the treated selected constituent hydrocarbon or group of constituent hydrocarbons from the canal or well.

24. An in-situ method for partially refining and extracting petroleum from a petroleum bearing reservoir by irradiation of the reservoir with electromagnetic energy of high frequency of mainly microwave region, comprising:

(a) ascertaining geophysical data and water content of the petroleum bearing reservoir;

(b) taking at least one core sample of the reservoir;

(c) testing the core sample to determine the respective amounts of constituent hydrocarbons in the petroleum, the molecular resonance frequencies of the respective constituent hydrocarbons, and the change in properties and response of the respective constituent hydrocarbons to various frequencies, intensities, durations and wave forms of electromagnetic field energy applied to the hydrocarbons;

(d) developing a strategy for the application of electromagnetic energy to a selected constituent hydrocarbon or group of constituent hydrocarbons in the reservoir based on the results of the core sample tests and the geophysical data and water content of the reservoir;

(e) excavating at least one canal or well in the reservoir for draining water from the reservoir and collecting hydrocarbons from the reservoir (f) covering an area above the reservoir with microwave reflective foil to reflect electromagnetic radiation to the reservoir;

(g) generating electromagnetic waves of mainly microwave frequency range and deploying the electromagnetic waves to the reservoir to irradiate a selected constituent hydrocarbon or a group of constituent hydrocarbons within the reservoir and thereby produce one or more of microwave flooding, plasma torch, molecular cracking and selective heating of the selected constituent hydrocarbon or group of constituent hydrocarbons in the reservoir, to increase temperature and reduce viscosity of the selected constituent hydrocarbon or group of constituent hydrocarbons in the reservoir so that they flow into the underground canal or well; and (h) removing the treated selected constituent hydrocarbon or group of constituent hydrocarbons from the canal or well.

25. An in-situ method for partially refining and extracting petroleum from a petroleum bearing reservoir by irradiation of the reservoir with electromagnetic energy of high frequency of mainly microwave region, comprising:

(a) ascertaining geophysical data and water content of the petroleum bearing reservoir;

(b) taking at least one core sample of the reservoir;

(c) testing the core sample to determine the amount of a selected constituent hydrocarbon contained in the petroleum;

(d) determining the molecular resonance frequency of the selected constituent hydrocarbon;

(e) developing a strategy for the application of electromagnetic energy to the selected constituent hydrocarbon in the reservoir based on the results of the core sample tests and the geophysical data and water content of the reservoir;

(f) excavating at least one canal or well in the reservoir for collecting the selected hydrocarbon from the reservoir;

(g) generating electromagnetic waves having a frequency generally identical to the molecular resonance frequency of the selected constituent hydrocarbon and deploying the electromagnetic waves to the reservoir to irradiate a selected constituent hydrocarbon within the reservoir and thereby producing one or more of microwave flooding, plasma torch, molecular cracking and selective heating of the selected hydrocarbon in the reservoir, thereby increasing a temperature and reducing a viscosity of the selected constituent hydrocarbon in the reservoir so that it flows into the underground canal or well; and (h) removing the selected constituent hydrocarbon from the canal or well.

* * * * *